US007419431B2

(12) United States Patent
Gauselmann et al.

(10) Patent No.: US 7,419,431 B2
(45) Date of Patent: Sep. 2, 2008

(54) GAME FOR A GAMING DEVICE HAVING DISPLAYED SYMBOLS CREATING A MAZE

(75) Inventors: Michael Gauselmann, Espelkamp (DE); Stefan Zimmermann, Graz (AT)

(73) Assignee: Atronic International GmbH, Lübbecke (DE)

( * ) Notice: Subject to any disclaimer, the term of this patent is extended or adjusted under 35 U.S.C. 154(b) by 730 days.

(21) Appl. No.: 10/340,368

(22) Filed: Jan. 9, 2003

(65) Prior Publication Data

US 2004/0137981 A1 Jul. 15, 2004

(51) Int. Cl.
*A63F 9/24* (2006.01)

(52) U.S. Cl. ..... 463/30; 463/25

(58) Field of Classification Search ..... 463/9, 463/15, 30; 273/366–368
See application file for complete search history.

(56) References Cited

U.S. PATENT DOCUMENTS 4,180,271 A * 12/1979 McMurchie ..... 273/275
5,996,997 A * 12/1999 Kamille ..... 273/139
6,315,660 B1 * 11/2001 DeMar et al. ..... 463/16
6,398,641 B1 * 6/2002 Yamagami et al. ..... 463/9
6,506,114 B1 * 1/2003 Estes et al. ..... 463/16
6,905,405 B2 * 6/2005 McClintic ..... 463/16
6,997,802 B2 * 2/2006 Gauselmann ..... 463/15
2002/0022509 A1 * 2/2002 Nicastro et al. ..... 463/15

FOREIGN PATENT DOCUMENTS

DE 37 02 134 A1 * 8/1988

OTHER PUBLICATIONS

"Crosstrack" from Wikipedia. Printed Dec. 5, 2006. http://en.wikipedia.org/wiki/Crosstrack.*

* cited by examiner

*Primary Examiner*—Corbett Coburn
*Assistant Examiner*—Omkar Deodhar
(74) *Attorney, Agent, or Firm*—Patent Law Group LLP; Brian D. Ogonowsky

(57) ABSTRACT

In one embodiment of the game, a matrix of symbols is displayed on a display screen. The matrix may be a 3×3 array of symbols or any other configuration. Each symbol has a selectable direction indicator that points to another symbol or out of the matrix. The direction indicators are randomly selected. An award is based on paths created by the direction indicators. The award may be determined by the path from an entrance into the matrix to an exit out of the matrix, or the award may be based on the patterns formed by the paths. The game may be a main game or a bonus game and can be displayed on a display screen or by motor-driven reels.

20 Claims, 12 Drawing Sheets

MULTIPLIER

X3

MULTIPLIER

X3

GAME FOR A GAMING DEVICE HAVING DISPLAYED SYMBOLS CREATING A MAZE

FIELD OF THE INVENTION

This invention relates to gaming machines and, in particular, to a game played on a gaming machine.

BACKGROUND

Typical gaming machines display spinning reels or a card game. Bonus games are sometimes offered, where a special outcome in the main game, such as a certain combination of symbols on the spinning reels, initiates a bonus game that may grant the player additional awards. The bonus game may take any form.

It is desirable to develop a game that is more appealing to players so that the gaming machine generates greater revenues.

SUMMARY

The present inventive game may be a bonus game or a main game in a gaming machine. In one embodiment of the game, a matrix of symbols is displayed on a display screen. The matrix may be a 3×3 array of symbols. Each of the symbols corresponds to a single step a player takes through the matrix. Each symbol has a selectable direction indicator that points to the player's next step through the matrix or out of the matrix. There is an entrance into the matrix and multiple exits out of the matrix.

The player starts at the entrance. The symbol at the start of the entrance rotates its direction indicator and randomly stops to indicate the direction of the next step (symbol) through the matrix. In one embodiment, the player stops the rotation of the symbol by touching the symbol on a touch screen. The next symbol (chosen by the direction indicator) then spins its direction indicator and stops to identify the direction of the next step through the matrix. This process continues until a combination of direction indicators leads the player out an exit of the matrix. At some or all of the exits is a displayed award. The player wins the award identified at the exit. One of the awards may be a progressive jackpot.

The game may either end after the player exits the matrix or end if the player does not win an award after exiting the matrix. A randomly selected multiplier may also be provided during the game, where the award obtained by exiting the matrix is multiplied by the multiplier.

This maze-type game allows the player to become involved in the game and, due to the changing directions, the player becomes excited as the player steps through the matrix towards a high award value exit.

The game can also be a main game, where different awards are granted based on patterns created by the direction indicators. The direction indicators may take any form, such as connectors or other figures. The game may be played using a video screen or mechanical reels.

Other variations of the game are described.

DETAILED DESCRIPTION

Although the invention can be easily implemented by modifying most types of modern gaming machines, one particular gaming machine platform will be described in detail.

Figure 1:
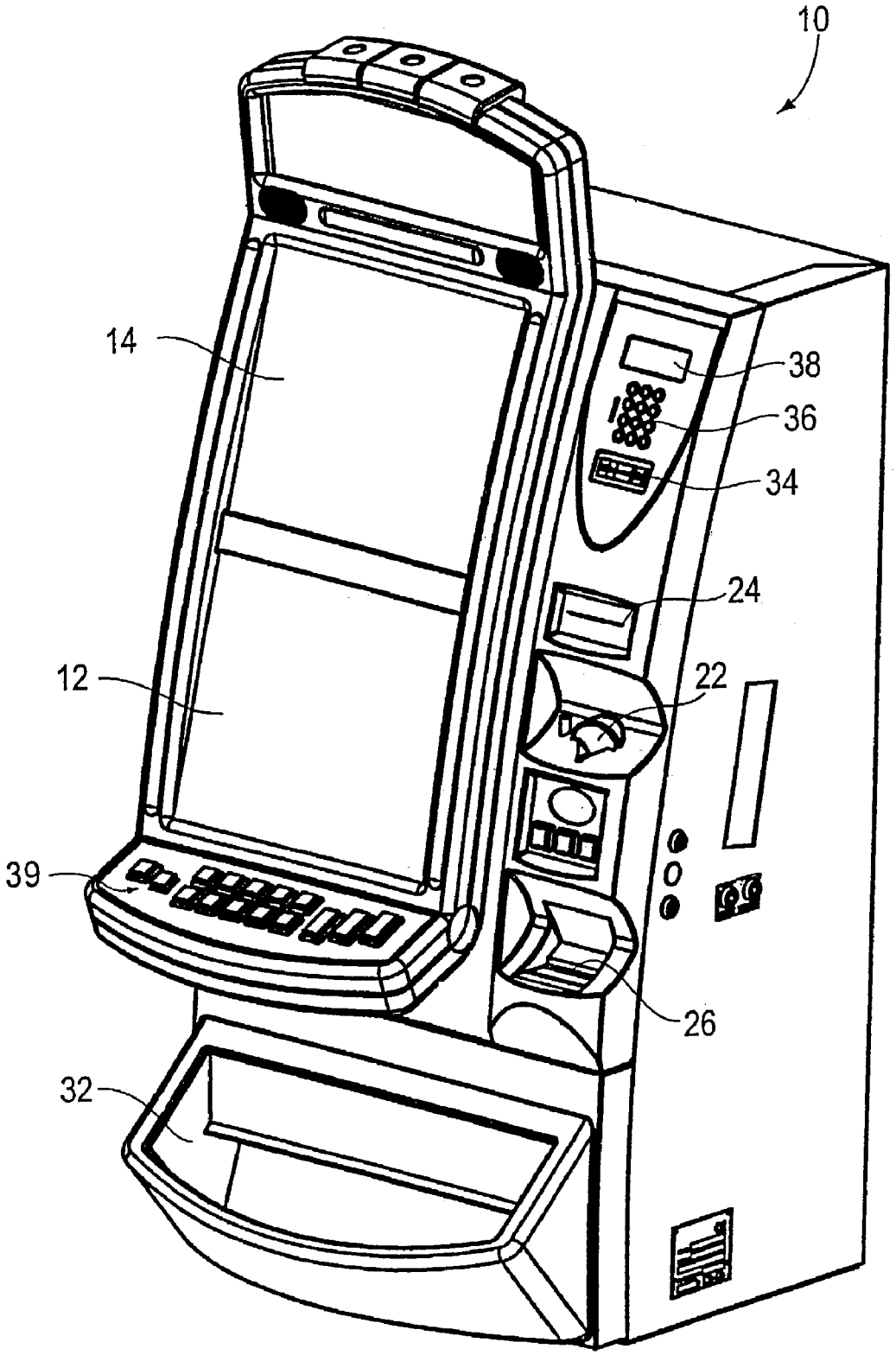
FIG. 1 is a perspective view of one type of gaming machine that may perform the inventive game.

FIG. 1 is a perspective view of a gaming machine 10 that incorporates software to carry out the present invention. Machine 10 includes a display 12 that may be a thin film transistor (TFT) display, a liquid crystal display (LCD), a cathode ray tube (CRT), or any other type of display. Display 12 may be a touch screen that allows a player to make a selection by touching the appropriate icon on the screen. A second display 14 provides game data or other information in addition to display 12. Display 14 may provide static information, such as an advertisement for the game, the rules of the game, pay tables, paylines, or other information, or may even display the game itself along with display 12. Alternatively, the area for display 14 may be a display glass for conveying information about the game.

A coin slot 22 accepts coins or tokens in one or more denominations to generate credits within machine 10 for playing games. An input slot 24 for an optical reader and printer receives machine readable printed tickets and outputs printed tickets for use in cashless gaming. A bill acceptor 26 accepts various denominations of banknotes.

A coin tray 32 receives coins or tokens from a hopper upon a win or upon the player cashing out.

A card reader slot 34 accepts any of various types of cards, such as smart cards, magnetic strip cards, or other types of cards conveying machine readable information. The card reader reads the inserted card for player and credit information for cashless gaming. The card reader may also include an optical reader and printer for reading and printing coded barcodes and other information on a paper ticket.

A keypad 36 accepts player input, such as a personal identification number (PIN) or any other player information. A display 38 above keypad 36 displays a menu for instructions and other information and provides visual feedback of the keys pressed.

Player control buttons 39 include any buttons needed for the play of the particular game or games offered by machine 10 including, for example, a bet button, a repeat bet button, a play two-ways button, a spin reels button, a deal button, hold cards buttons, a draw button, a maximum bet button, a cash-out button, a display paylines button, a display payout tables button, select icon buttons, and any other suitable button. In other embodiments, buttons 39 are replaced by a touch screen with virtual buttons.

Figure 2:
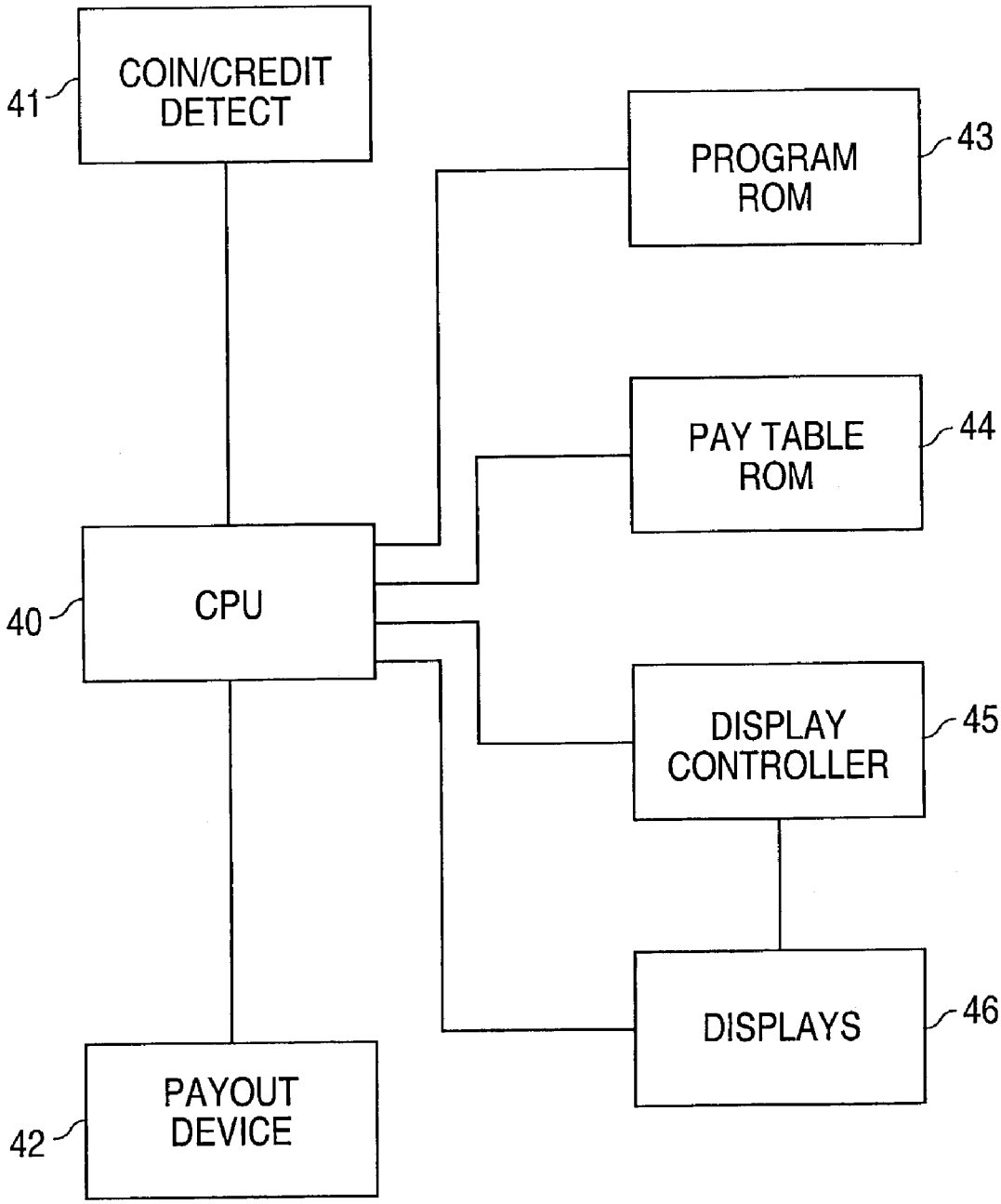
FIG. 2 is a block diagram of various components in a conventional gaming machine that can be used to carry out the game of the present invention.

FIG. 2 illustrates basic circuit blocks in a suitable gaming device. A control unit (CPU 40) runs a gaming program stored in a program ROM 43. A coin/bill/credit detector 41 enables the CPU 40 to initiate a next game. A pay table ROM 44 detects the outcome of the game and identifies awards to be paid to the player. A payout device 42 pays out an award to the player in the form of coins upon termination of the game or upon the player cashing out. The payout device 42 may instead generate a payout in the form of a coded paper ticket, credits on a smart card or magnetic strip card, or in any other form. A display controller 45 receives commands from the CPU 40 and generates signals for the various displays 46. Player commands to the CPU 40 may be input through the buttons or touch screen(s).

Figure 3:
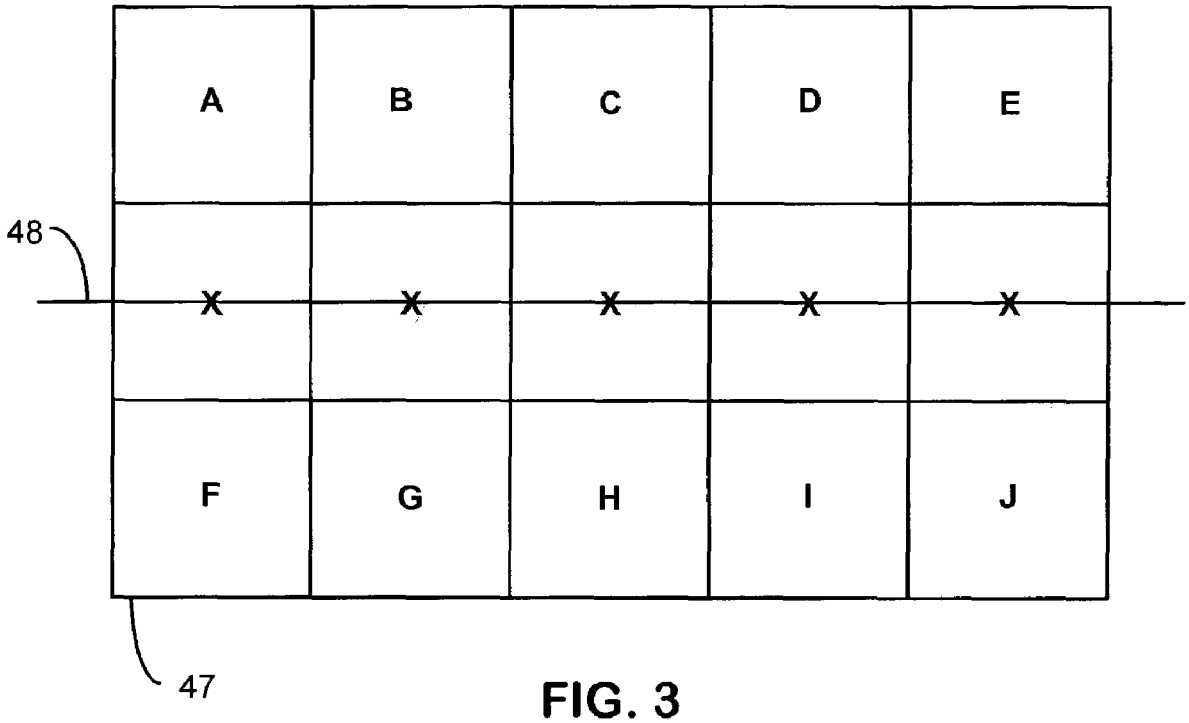
FIG. 3 illustrates an outcome of a conventional spinning reels type game, where a special outcome is obtained that initiates a bonus game.

In one embodiment of the invention, the inventive game is a bonus game pursuant to a special outcome of a main game. As an example, the main game may be the random stopping of actual or virtual reels. FIG. 3 illustrates a final display of five reels 47, each reel displaying three symbols. Five special symbols (X's) appear across the center payline 48, which initiates a bonus game. Any type of main game can be played, and any outcome can be designated as an outcome that initiates the bonus game. The gaming program for the main game may be conventional.

Figure 4:
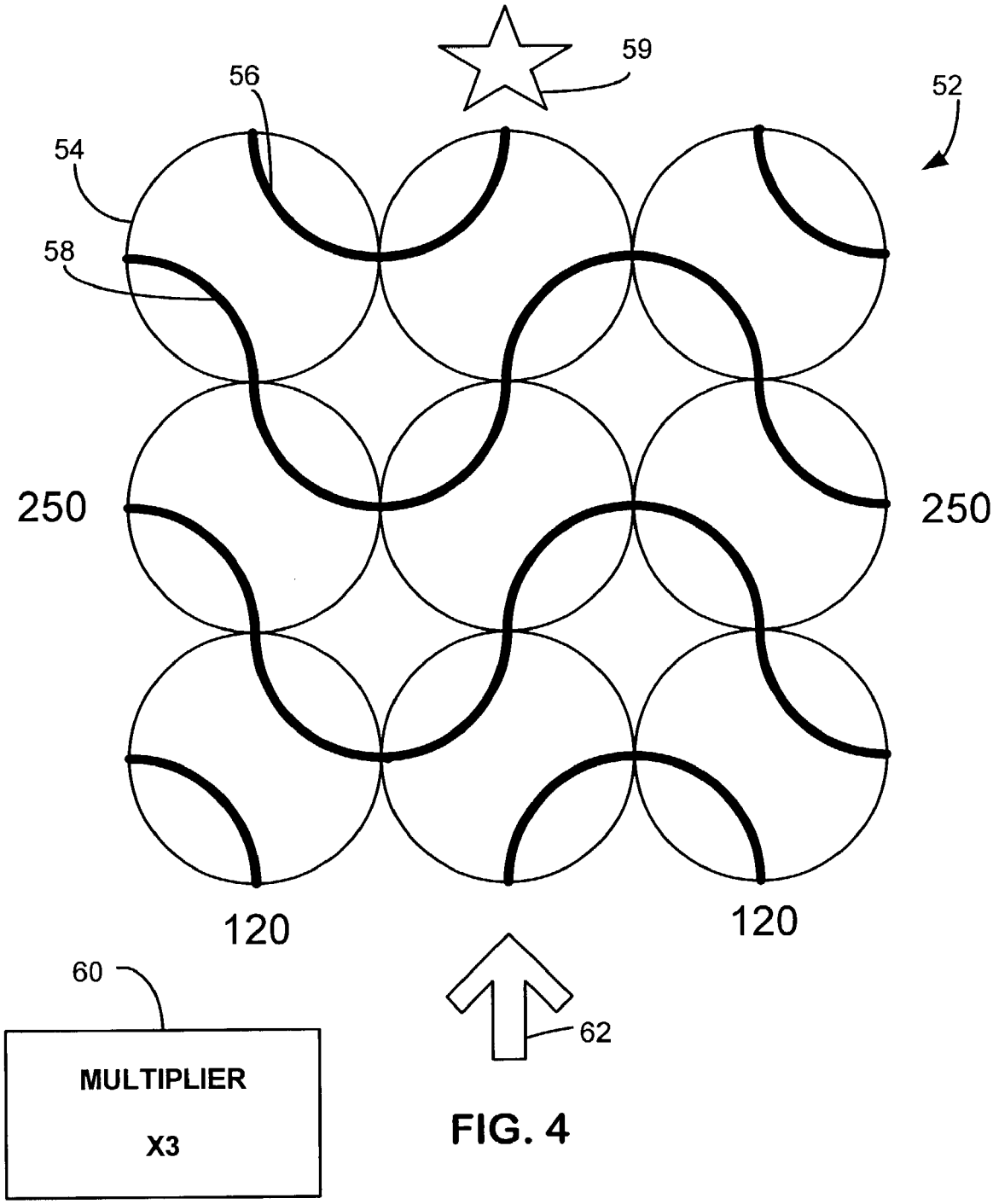
FIG. 4 is a simplified version of the initial screen of the maze-type bonus game.

After the special outcome has been achieved in the main game, the machine's microprocessor then carries out the program for the bonus game. FIG. 4 is a simplified illustration of the initial display for the bonus game, comprising a matrix 52 of direction indicator symbols 54. Nine direction indicator symbols 54 are shown. In one embodiment, each symbol 54, when activated, spins and is stopped by the player by the player touching the symbol (via a touch screen). The spinning symbol gradually comes to a stop. In other embodiments, the player starts the rotation by touching the symbol and the machine stops the rotation, or either the player or the machine controls both the starting and stopping of the rotation.

Any type of controller may be used to control the game, such as buttons. Each spinning symbol 54 identifies two paths 56 and 58, one of which is randomly selected for designating an adjacent symbol 54 or exit of the matrix. Various awards are identified at exits of the matrix. One of the exits 59 may designate a progressive jackpot award. An award may be multiplied by a multiplier 60 randomly selected at the start of the game. An exemplary game is described below.

Figure 5:
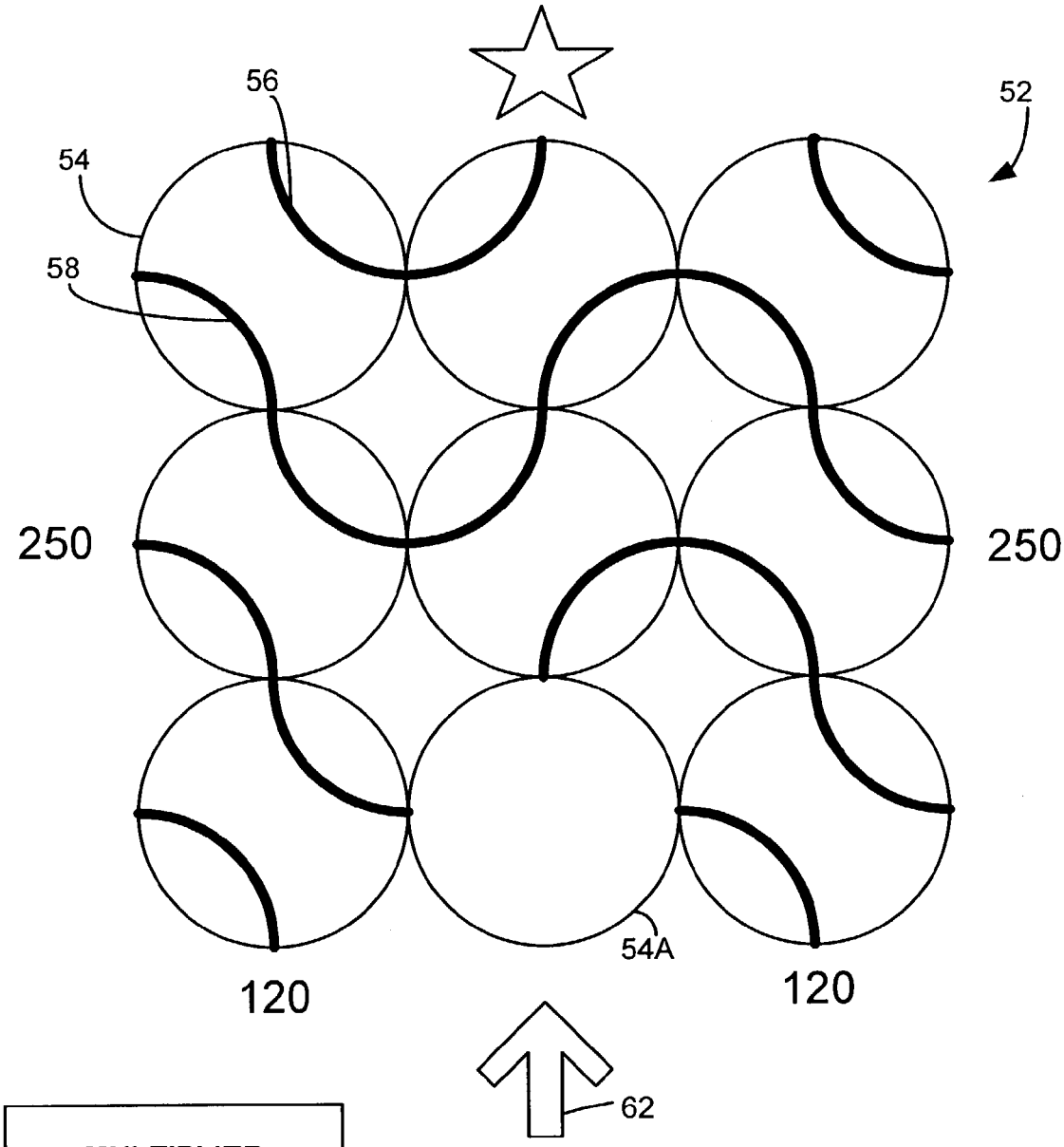
FIG. 5 illustrates the screen after the symbol at the entrance to the maze starts spinning, where the player stops the spinning symbol to determine the next step or symbol in the matrix.

The player starts at the entrance 62 to matrix 52. As shown in FIG. 5, symbol 54A rotates. The player is informed on the display screen to touch the rotating symbol 54A to stop its rotation. The player then touches symbol 54A, and symbol 54A gradually comes to a stop.

Figure 6:
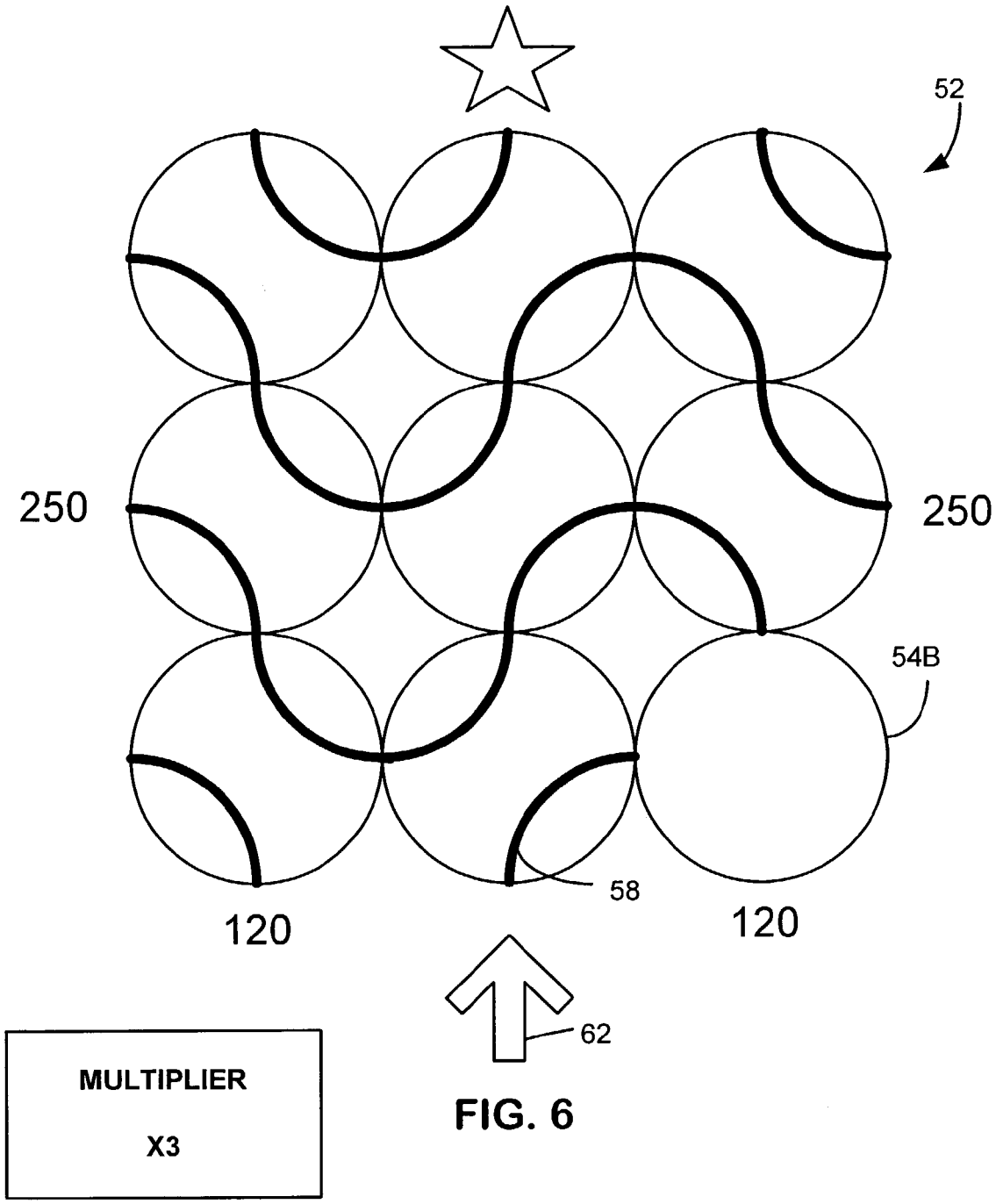
FIGS. 6, 7, and 8 illustrate further displays as the player progresses through the maze, based upon the randomly selected directions identified by each symbol, and exits the maze to win 250 credits, which are then multiplied by a random multiplier.
Figure 7:
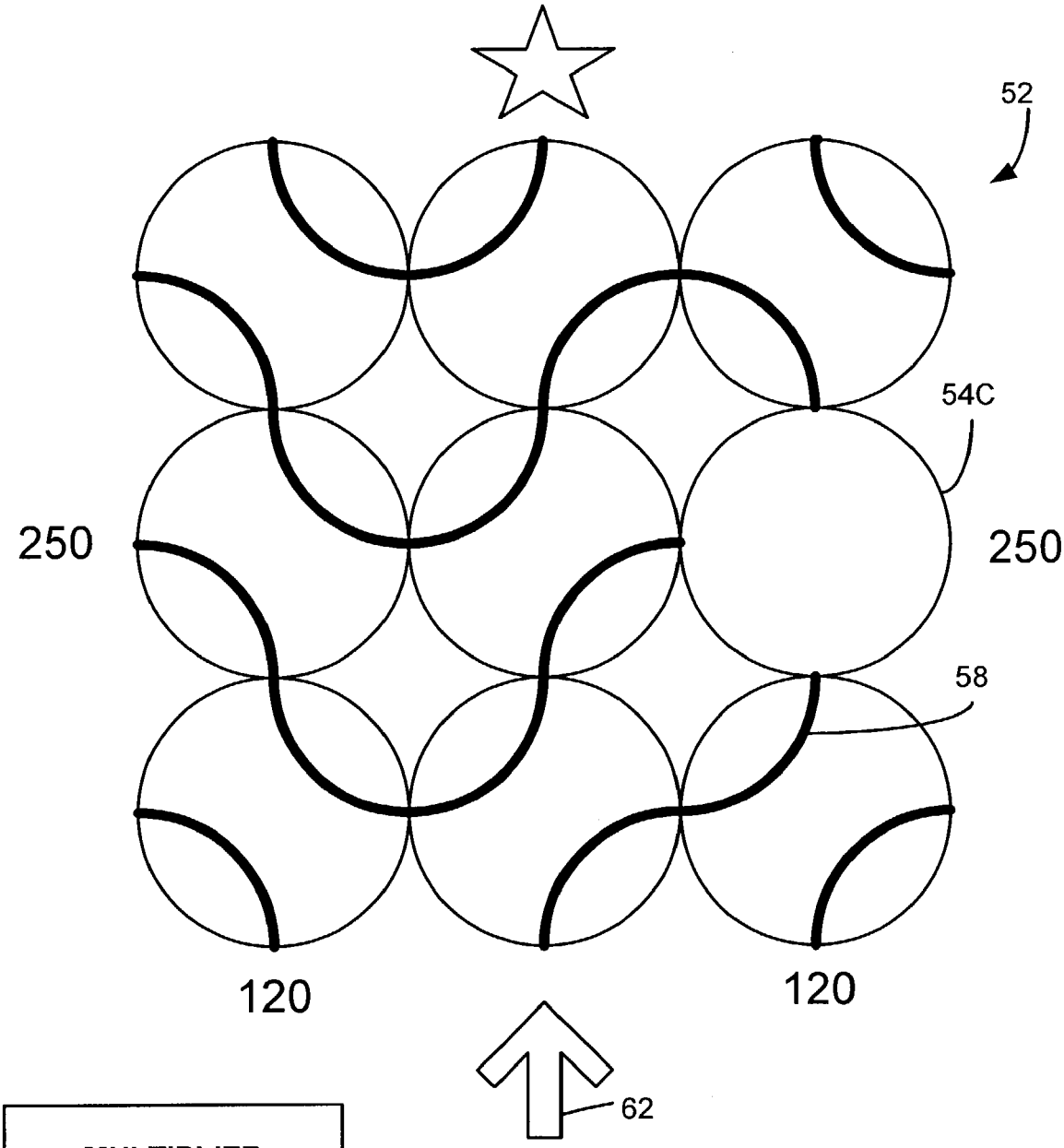
Figure 8:
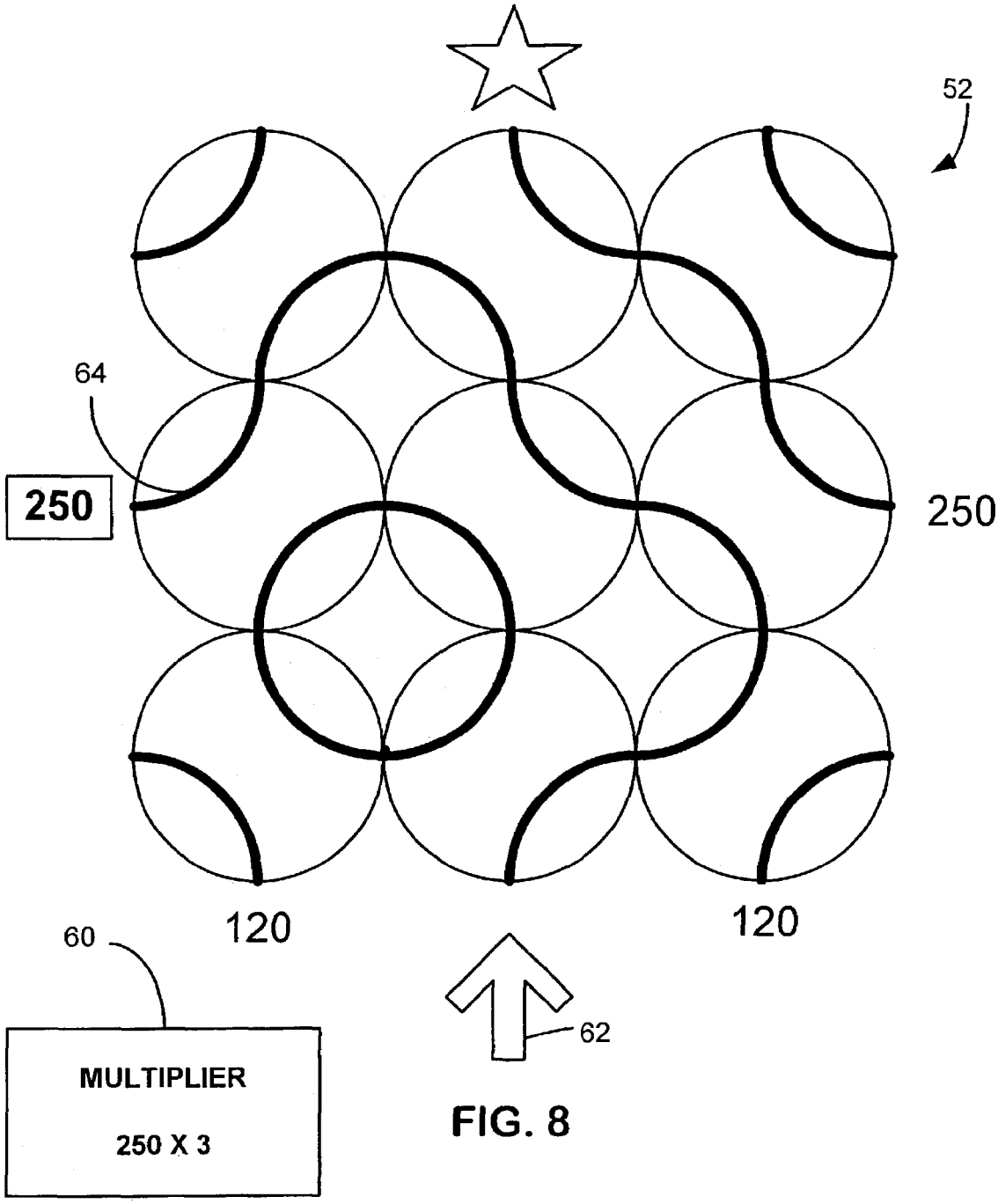

FIG. 6 illustrates that symbol 54A has stopped such that path 58 connects the entrance 62 to symbol 54B. The selected path 58 may be illuminated or otherwise highlighted to show the player the pertinent path. The symbol 54B then begins rotating, and the player stops symbol 54B as before. FIG. 7 illustrates that symbol 54B has stopped such that path 58 connects the entrance 62 to symbol 54C. Symbol 54C then spins and is stopped. This process continues through matrix 52 until the player exits matrix 52. FIG. 8 illustrates a completed path 64 taken through matrix 52 to achieve the award of 250 credits identified at the path 64 exit.

In the example shown in FIG. 8, the award of 250 credits is multiplied by the multiplier of 3 to provide the player 750 credits.

Numerous algorithms may be used to select a path through matrix 52. For example, the machine's microprocessor may initially select a complete path through the matrix, and the individual symbols 54 would stop rotating at a predetermined position to complete the selected path. Alternately, the final position of each symbol 54 may be individually randomly determined (by the player or the microprocessor) such that the path is not determined until the last symbol position is determined. The random selection may be carried out by a random number generator program, where the value (e.g., even or odd) of the random number designates an outcome of an activated symbol 54. The probability of selecting a particular path may be weighted (e.g., 30:70). In another embodiment, the player may choose a direction for a particular symbol. Numerous other algorithms may be used.

Figure 9:
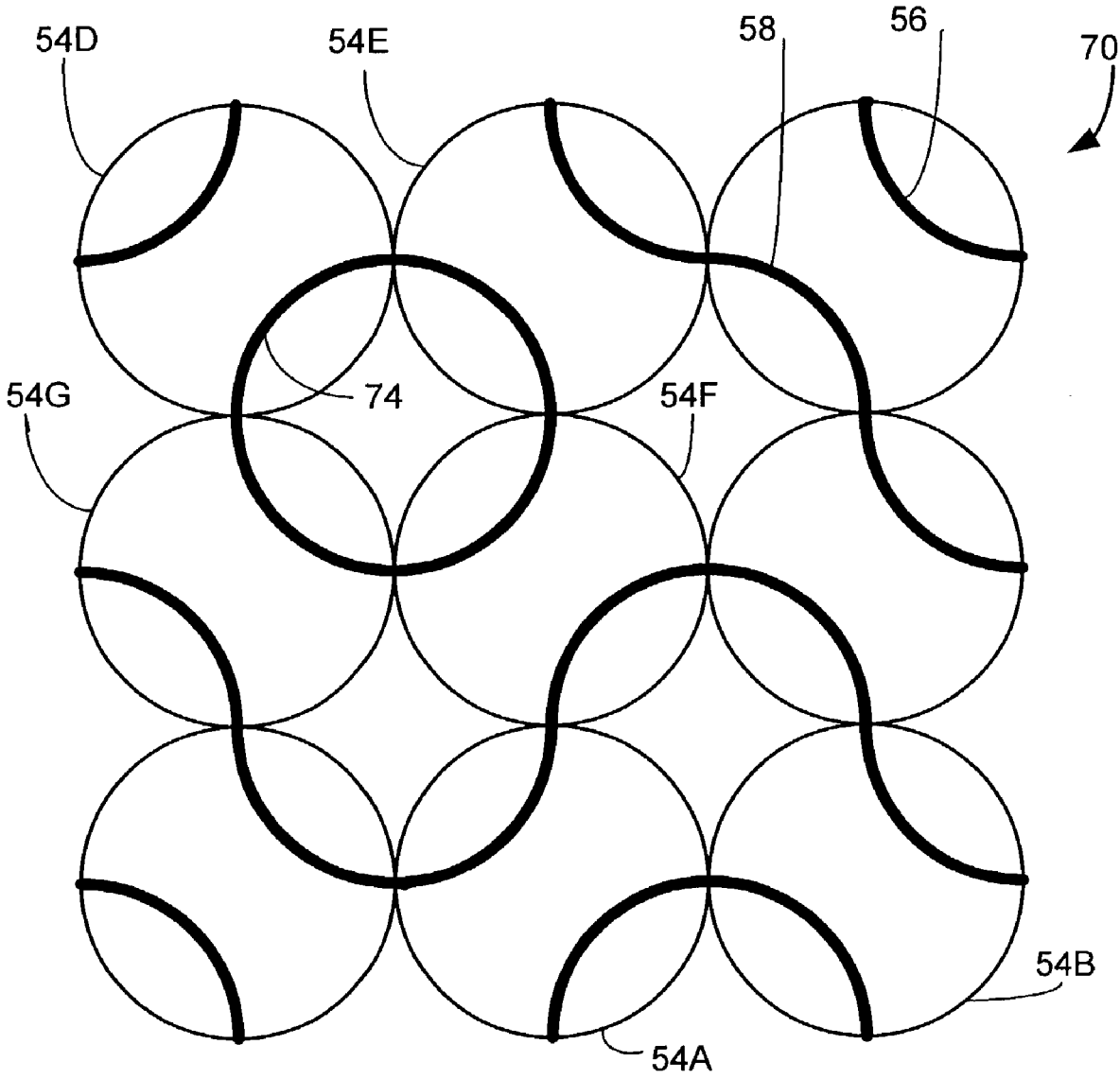
FIG. 9 illustrates a display of the matrix of symbols for a main game, where the symbols rotate and the award is based on patterns created by the symbols.

In other embodiments, the game is a main game in a gaming machine. In a main game, awards are typically not as likely to be granted as in a bonus game. One embodiment of a main game using the concept of direction indicator symbols is illustrated in FIG. 9. The player may be presented with a matrix 70 of direction indicator symbols 54 as an initial screen after making a wager. All the symbols 54 may rotate at the same time, and the player touches each symbol in turn. Alternately, the microprocessor stops each symbol 54 in a random sequence. Awards are granted based upon the patterns made by the various paths 56, 58 on the stopped symbols 54. For example, the circle pattern 74 made by symbols 54D, 54E, 54F, and 54G grants an award amount to the player based upon the likelihood of such a pattern occurring. Another winning pattern, but lower paying than a circle pattern, may be that shown by the combination of symbols 54A and 54B. Other patterns may include a pattern that connects one side of matrix 70 to another side or patterns that connect one particular symbol 54 to another particular symbol 54. Awards may also be granted for a path leading to a particular exit of the matrix.

Figure 10:
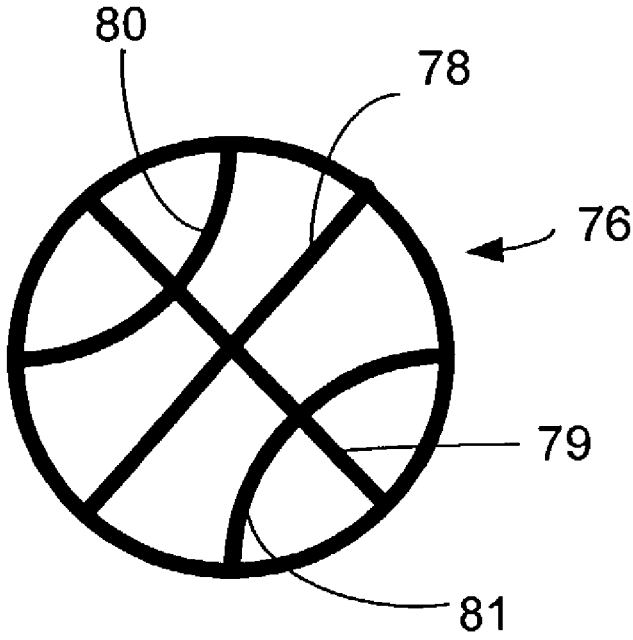
FIG. 10 illustrates another type of symbol identifying three possible directions.

The symbols 54 may take any form, such as right angled lines or other images. For example, each direction indicator symbol may simply be a single arrow that randomly changes shape to point to different adjacent symbols or an exit. FIG. 10 illustrates a symbol 76 that includes straight paths 78 and 79 in addition to curved paths 80 and 81. Each path may have a different probability of being selected. The patterns created may include rectangles or any other shape. The shapes may even be 3-dimentional.

Figure 11:
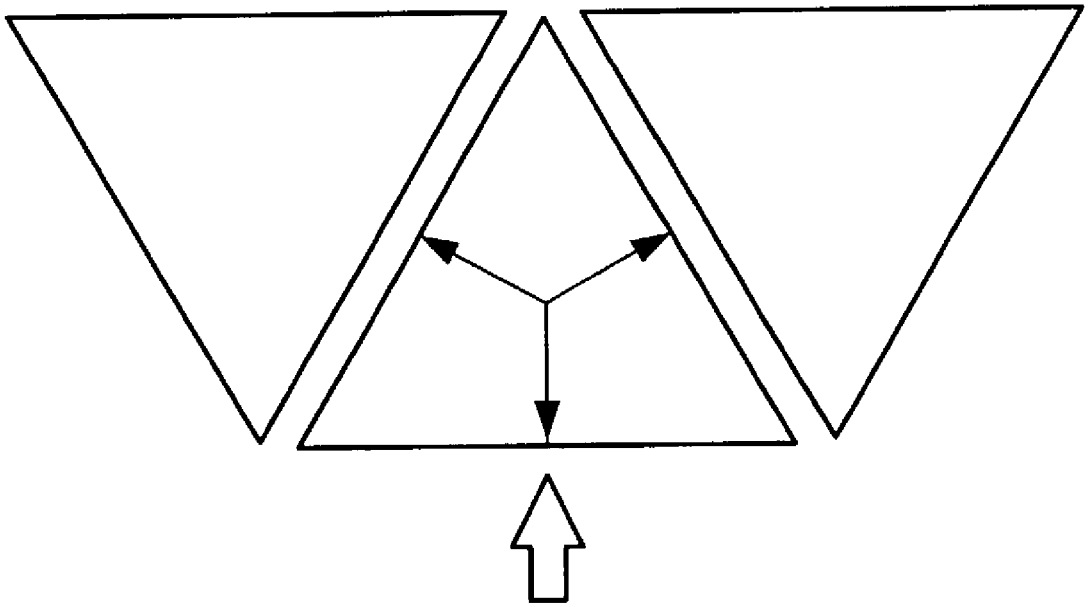
FIGS. 11, 12, and 13 illustrate other types of symbols identifying various directions.

FIG. 11 illustrates three triangles in an array, where any one of three directions may be selected to point to the next triangle in the array. Instead of arrows showing the path, a side of the triangle (or other symbol) may be highlighted, or any other technique may be used.

Figure 12:
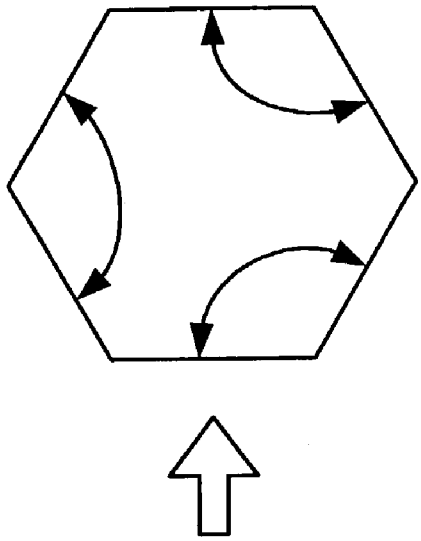

FIG. 12 illustrates a hexagon in any array of hexagons, where a path through the hexagon is selected. In one embodiment, any side of the hexagon may be highlighted to show the path to the next hexagon or to an exit.

Figure 13:
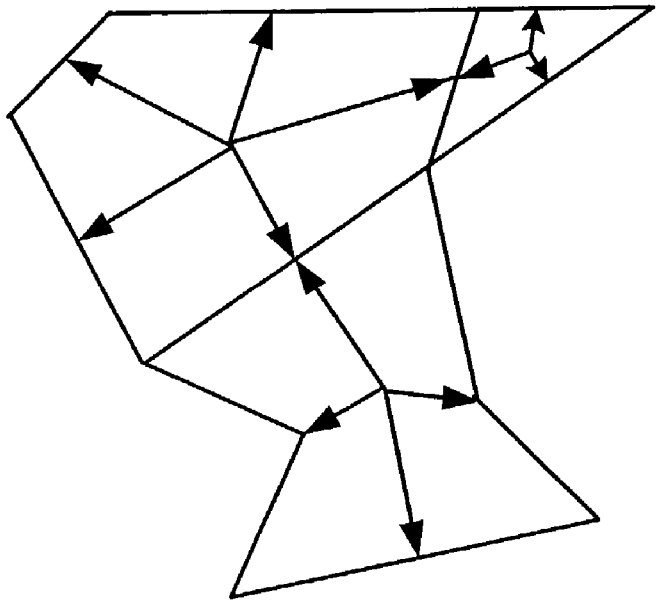

FIG. 13 illustrates that the array need not repeat the same symbol, but any combination of symbols can be used, where a path is selected from one symbol to the next or to an exit.

In another embodiment, the array appears to form a 3-dimensional sphere having no borders, such as a soccer ball. Awards may be granted for patterns formed or based on any other criteria.

Figure 14:
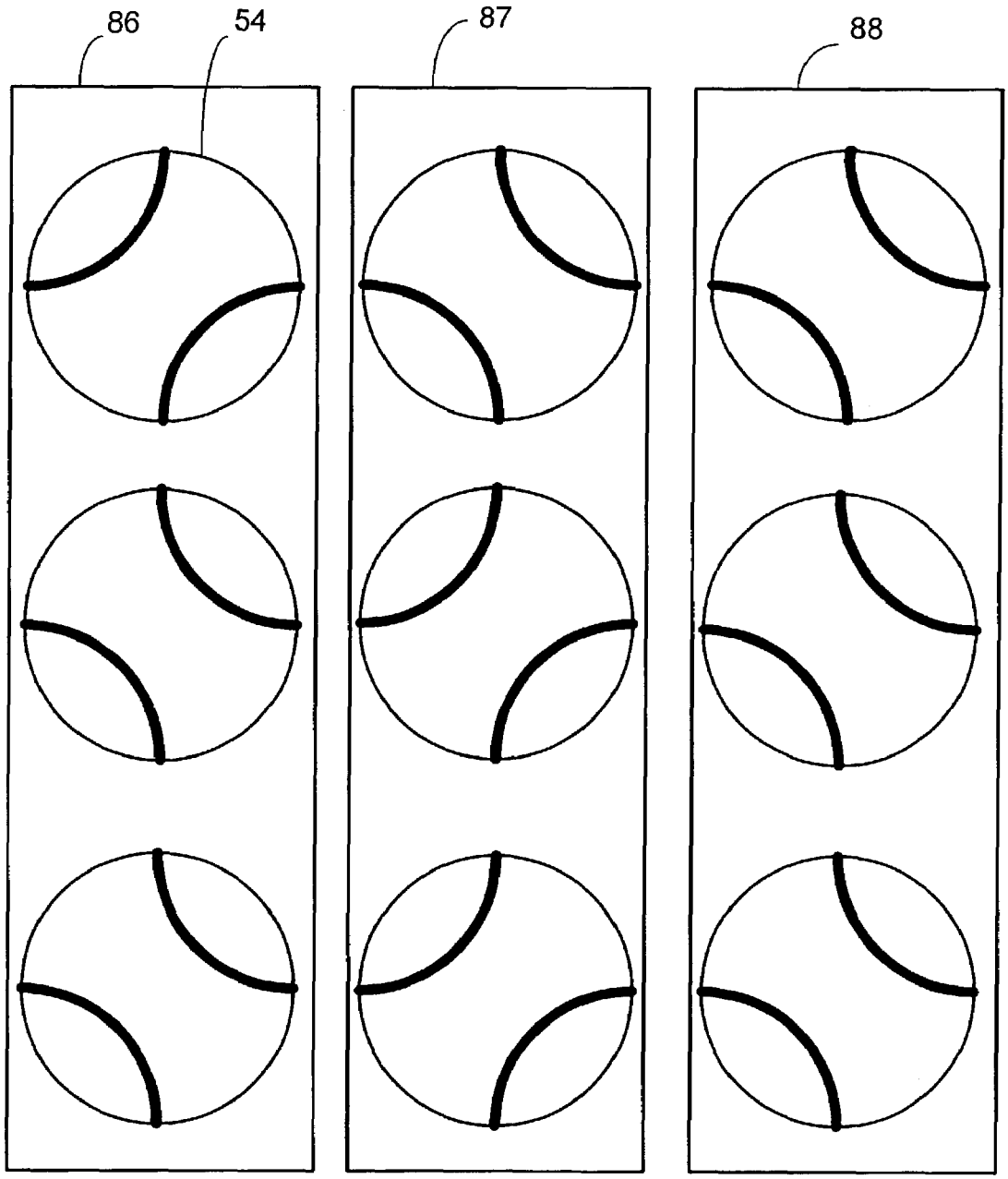
FIG. 14 illustrates how the game of FIG. 4 may be played using motor-driven reels.

In another embodiment, the direction indicator symbols 54 may be presented in a spinning reels type game, such as shown in FIG. 14, where symbols 54 in a vertical column are symbols on a single reel. The reels 86, 87, 88 are randomly stopped, and the award is based upon the patterns created by symbols 54. Reels 86-88 may be actual motor-driven reels or virtual reels displayed on a display screen.

Numerous other embodiments using this general concept are possible and depend upon the particular presentation to be made to the player. The player need not have control in the game. Other features may be used in combination with this general concept of forming patterns or paths in a matrix. For example, between two adjacent symbols, an identified award may be granted if a path bridges the two symbols. Numerous other derivative games are envisioned. The game may also be applied to on-line gaming and gaming devices using a central server. One skilled in the art of programming gaming machines would understand how to program such machines to carry out the invention without undue experimentation.

Having described the invention in detail, those skilled in the art would appreciate that, given the present disclosure, modifications may be made to the invention without departing from the spirit of the inventive concepts described herein. Therefore, it is not intended that the scope of the invention be limited to the specific embodiments illustrated and described.

What is claimed is:

1. A method performed by a gaming device comprising:

providing a matrix of symbol positions, wherein each symbol position in the matrix at a start of a game has an associated path indicator symbol, each symbol position, at least when active, displaying an associated path indicator symbol that is movable and stoppable to select one of a plurality of possible paths through the matrix of symbol positions when that symbol position is made active;

selecting one of the possible paths at an active symbol position by displaying movement of its associated path indicator symbol and stopping the associated path indicator symbol so as to display one of the plurality of possible paths, wherein the selecting comprises randomly selecting one of the paths for at least some of the symbol positions in the matrix; and granting an award to a player based on a combination of the paths within the matrix;

wherein the combination of paths leads from an entrance of the matrix to one of a plurality of exits of the matrix, wherein granting an award comprises granting an award based on the particular one of the plurality of exits, wherein exits have different award values.

2. The method of claim 1 wherein a microprocessor selects one of the paths for at least some of the symbol positions in the matrix.

3. The method of claim 1 wherein the player, in part, controls selecting one of the paths for at least some of the symbol positions in the matrix.

4. The method of claim 1 wherein the selecting comprises spinning a path indicator symbol and stopping the spinning to identify a path.

5. The method of claim 1 wherein the matrix is a 3×3 array of symbol positions.

6. The method of claim 1 wherein each of the paths comprises 90 degree turns.

7. The method of claim 1 wherein each of the paths comprises a straight through path.

8. The method of claim 1 further comprising multiplying the award by a multiplier.

9. The method of claim 1 wherein the displaying a matrix of symbol positions is a bonus game after a special outcome of a main game.

10. The method of claim 1 wherein the combination of paths form one or more patterns in the matrix, wherein granting an award comprises granting an award based on the one or more patterns formed.

11. The method of claim 10 wherein the selecting comprises spinning a path indicator symbol and stopping the spinning to identify a path.

12. The method of claim 10 wherein the displaying matrix of symbol positions is a main game.

13. The method of claim 10 wherein the patterns comprise at least one of circles, squares, or paths from one point in the matrix to another point in the matrix.

14. The method of claim 1 wherein the displaying a matrix is performed on a display screen.

15. The method of claim 1 wherein the displaying a matrix is performed on motor driven reels.

16. The method of claim 1 wherein the path indicator symbols in the symbol positions have a variety of shapes.

17. The method of claim 1 wherein the path indicator symbols in the symbol positions have the same shape.

18. A gaming device comprising:

a display portion for displaying a matrix of symbols, wherein each symbol position in the matrix at a start of a game has an associated path indicator symbol, each symbol position displaying, at least when active, an associated path indicator symbol that is movable and stoppable to select one of a plurality of possible paths through the matrix of symbol positions when that symbol position is made active;

circuitry for selecting one of the possible paths at an active symbol position by displaying movement of its associated path indicator symbol and stopping the associated path indicator symbol so as to display one of the plurality of possible paths wherein the selecting comprises randomly selecting one of the paths for at least some of the symbol positions in the matrix; and circuitry for granting an award to a player based on a combination of the paths within the matrix, wherein the combination of paths leads from an entrance of the matrix to one of a plurality of exits of the matrix, wherein granting an award comprises granting an award based on the particular one of the plurality of exits, wherein exits have different award values.

19. The device of claim 18 wherein the combination of paths form one or more patterns in the matrix, wherein the circuitry grants an award based on the one or more patterns formed.

20. The method of claim 1 wherein each associated path indicator symbol is displayed on a video screen and movement of a path indicator symbol is virtual movement.

* * * * *